US010796623B2

(12) United States Patent
Crounse

(10) Patent No.: US 10,796,623 B2
(45) Date of Patent: Oct. 6, 2020

(54) METHODS AND APPARATUSES FOR DRIVING DISPLAY SYSTEMS

(71) Applicant: E Ink Corporation, Billerica, MA (US)

(72) Inventor: Kenneth R Crounse, Somerville, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 15/139,714

(22) Filed: Apr. 27, 2016

(65) Prior Publication Data

US 2016/0314733 A1 Oct. 27, 2016

Related U.S. Application Data

(60) Provisional application No. 62/153,452, filed on Apr. 27, 2015.

(51) Int. Cl.
*G09G 3/20* (2006.01)
*G09G 3/34* (2006.01)

(52) U.S. Cl.
CPC ..... *G09G 3/2055* (2013.01); *G09G 3/2003* (2013.01); *G09G 3/344* (2013.01); *G09G 2320/0209* (2013.01); *G09G 2320/0285* (2013.01); *G09G 2340/16* (2013.01)

(58) Field of Classification Search
CPC .... G09G 3/2055; G09G 3/2003; G09G 3/344; G09G 2320/0209; G09G 2320/0285; G09G 2340/16; G09G 3/2062; G09G 3/2059; G09G 2310/0224; H04N 1/52; G06T 5/30
See application file for complete search history.

(56) References Cited

U.S. PATENT DOCUMENTS 5,543,855 A * 8/1996 Yamada ..... G09G 3/2059 348/752
5,909,512 A 6/1999 Ohshima et al.
5,930,026 A 7/1999 Jacobson
6,084,560 A 7/2000 Miyamoto
6,134,024 A 10/2000 Miura
6,241,921 B1 6/2001 Jacobson
6,445,489 B1 9/2002 Jacobson et al.
6,504,524 B1 1/2003 Gates
(Continued)

OTHER PUBLICATIONS

Korean Intellectual Property Office; PCT/US2016/029498; International Search Report and Written Opinion; dated Jul. 26, 2016 Jul. 26, 2016.

(Continued)

*Primary Examiner* — Richard J Hong
(74) *Attorney, Agent, or Firm* — Zhen Bao

(57) ABSTRACT

Methods and apparatus for image processing are provided. A method for image processing includes: (a) accessing, in a lookup table, a current pattern index for a current pixel based on a current pixel input value and a previous pattern index; (b) accessing, in a dither mask array, a threshold value for the current pixel based on a location of the current pixel; (c) comparing the current pattern index with the threshold value; (d) determining a current pixel output value for activation of the current pixel based on a result of the comparing; (e) storing the current pattern index to serve as the previous pattern index for a next image; and (f) repeating acts (a)-(e) for each pixel in the image.

20 Claims, 9 Drawing Sheets

(56) References Cited

U.S. PATENT DOCUMENTS

| | | | |
|---|---|---|---|
| 6,512,354 | B2 | 1/2003 | Jacobson |
| 6,531,997 | B1 | 3/2003 | Gates |
| 6,753,999 | B2 | 6/2004 | Zehner, Jr. |
| 6,825,970 | B2 | 11/2004 | Goenaga |
| 6,844,882 | B1 | 1/2005 | Clauson |
| 6,900,851 | B2 | 5/2005 | Morrison et al. |
| 6,922,276 | B2 | 7/2005 | Zhang et al. |
| 6,950,220 | B2 | 9/2005 | Abramson et al. |
| 6,982,178 | B2 | 1/2006 | LeCain et al. |
| 6,995,550 | B2 | 2/2006 | Jacobson |
| 7,002,728 | B2 | 2/2006 | Pullen et al. |
| 7,012,600 | B2 | 3/2006 | Zehner |
| 7,023,420 | B2 | 4/2006 | Comiskey et al. |
| 7,034,783 | B2 | 4/2006 | Gates |
| 7,075,502 | B1 | 7/2006 | Drzaic |
| 7,116,318 | B2 | 10/2006 | Amundson et al. |
| 7,116,466 | B2 | 10/2006 | Whitesides et al. |
| 7,119,772 | B2 | 10/2006 | Amundson |
| 7,193,625 | B2 | 3/2007 | Danner et al. |
| 7,202,847 | B2 | 4/2007 | Gates |
| 7,259,744 | B2 | 8/2007 | Arango |
| 7,304,787 | B2 | 12/2007 | Whitesides et al. |
| 7,312,784 | B2 | 12/2007 | Baucom et al. |
| 7,312,794 | B2 | 12/2007 | Zehner |
| 7,327,511 | B2 | 2/2008 | Whitesides et al. |
| 7,411,719 | B2 | 8/2008 | Paolini, Jr. et al. |
| 7,420,549 | B2 | 9/2008 | Jacobson |
| 7,453,445 | B2 | 11/2008 | Amundson |
| 7,492,339 | B2 | 2/2009 | Amundson |
| 7,528,822 | B2 | 5/2009 | Amundson |
| 7,535,624 | B2 | 5/2009 | Amundson et al. |
| 7,583,251 | B2 | 9/2009 | Arango |
| 7,602,374 | B2 | 10/2009 | Zehner et al. |
| 7,612,760 | B2 | 11/2009 | Kawai |
| 7,679,599 | B2 | 3/2010 | Kawai |
| 7,679,814 | B2 | 3/2010 | Paolini, Jr. et al. |
| 7,688,297 | B2 | 3/2010 | Zehner et al. |
| 7,729,039 | B2 | 6/2010 | LeCain et al. |
| 7,733,311 | B2 | 6/2010 | Amundson |
| 7,733,335 | B2 | 6/2010 | Zehner et al. |
| 7,787,169 | B2 | 8/2010 | Abramson et al. |
| 7,839,564 | B2 | 11/2010 | Whitesides et al. |
| 7,952,557 | B2 | 5/2011 | Amundson et al. |
| 7,956,841 | B2 | 6/2011 | Albert |
| 7,999,787 | B2 | 8/2011 | Amundson |
| 8,009,348 | B2 | 8/2011 | Zehner |
| 8,077,141 | B2 | 12/2011 | Duthaler |
| 8,125,501 | B2 | 2/2012 | Amundson |
| 8,130,192 | B2 | 3/2012 | Ricoh |
| 8,139,050 | B2 | 3/2012 | Jacobson et al. |
| 8,174,490 | B2 | 5/2012 | Whitesides |
| 8,203,547 | B2 | 6/2012 | Erol et al. |
| 8,289,250 | B2 | 10/2012 | Zehner |
| 8,300,006 | B2 | 10/2012 | Zhou |
| 8,305,341 | B2 | 11/2012 | Arango |
| 8,314,784 | B2 | 11/2012 | Ohkami |
| 8,319,759 | B2 | 11/2012 | Jacobson |
| 8,384,658 | B2 | 2/2013 | Albert |
| 8,558,783 | B2 | 10/2013 | Wilcox |
| 8,558,785 | B2 | 10/2013 | Zehner |
| 8,928,562 | B2 | 1/2015 | Gates et al. |
| 8,958,129 | B1 | 2/2015 | Bielak |
| 8,994,705 | B2 | 3/2015 | Jacobson |
| 9,230,492 | B2 | 1/2016 | Harrington |
| 9,412,314 | B2 | 8/2016 | Amundson |
| 2003/0102858 | A1 | 6/2003 | Jacobson et al. |
| 2004/0150846 | A1 | 8/2004 | Jeong |
| 2005/0253777 | A1 | 11/2005 | Zehner et al. |
| 2007/0091418 | A1 | 4/2007 | Danner et al. |
| 2007/0103427 | A1 | 5/2007 | Zhou |
| 2008/0024429 | A1 | 1/2008 | Zehner |
| 2008/0024482 | A1 | 1/2008 | Gates |
| 2008/0136774 | A1 | 6/2008 | Harris |
| 2008/0291129 | A1 | 11/2008 | Harris |
| 2009/0174651 | A1 | 7/2009 | Jacobson |
| 2009/0195568 | A1 | 8/2009 | Sjodin |
| 2009/0322721 | A1 | 12/2009 | Zehner |
| 2010/0149340 | A1* | 6/2010 | Marks ..... G06T 5/30 348/169 |
| 2010/0220121 | A1 | 9/2010 | Zehner |
| 2010/0265561 | A1 | 10/2010 | Gates et al. |
| 2011/0193840 | A1 | 8/2011 | Amundson |
| 2011/0193841 | A1 | 8/2011 | Amundson |
| 2011/0199671 | A1 | 8/2011 | Amundson |
| 2012/0293858 | A1 | 11/2012 | Telfer |
| 2013/0194250 | A1 | 8/2013 | Amundson |
| 2014/0078035 | A1* | 3/2014 | Sato ..... G09G 3/344 345/107 |

OTHER PUBLICATIONS

European Patent Office, EP Appl. No. 16787041.9, Extended European Search Report, dated Oct. 18, 2018.

* cited by examiner

210

| | | Pixel Value | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| Previous Pattern Index | 1 | 4 | 15 | 28 | 44 | 61 | 75 | 89 | 105 | 122 | 139 | 155 | 173 | 193 | 213 | 235 | 256 |
| | 2 | 4 | 15 | 29 | 44 | 62 | 75 | 89 | 105 | 123 | 139 | 155 | 173 | 193 | 213 | 235 | 256 |
| | ⋮ | | | | | | | | ⋮ | | | | | | | | |
| | 21 | 4 | 20 | 33 | 49 | 65 | 78 | 93 | 109 | 127 | 141 | 158 | 175 | 194 | 213 | 235 | 256 |
| | ⋮ | | | | | | | | ⋮ | | | | | | | | |
| | 49 | 3 | 19 | 37 | 55 | 70 | 83 | 98 | 115 | 132 | 145 | 161 | 177 | 196 | 215 | 235 | 256 |
| | ⋮ | | | | | | | | ⋮ | | | | | | | | |
| | 256 | 1 | 14 | 31 | 50 | 70 | 88 | 108 | 129 | 141 | 154 | 168 | 184 | 201 | 218 | 236 | 256 |

FIG. 3

220

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 0 | 128 | 32 | 160 | 8 | 136 | 40 | 168 | 2 | 130 | 34 | 162 | 10 | 138 | 42 | 170 |
| 192 | 64 | 224 | 96 | 200 | 72 | 232 | 104 | 194 | 66 | 226 | 98 | 202 | 74 | 234 | 106 |
| 48 | 176 | 16 | 144 | 56 | 184 | 24 | 152 | 50 | 178 | 18 | 146 | 58 | 186 | 26 | 154 |
| 240 | 112 | 208 | 80 | 248 | 120 | 216 | 88 | 242 | 114 | 210 | 82 | 250 | 122 | 218 | 90 |
| 12 | 140 | 44 | 172 | 4 | 132 | 36 | 164 | 14 | 142 | 46 | 174 | 6 | 134 | 38 | 166 |
| 204 | 76 | 236 | 108 | 196 | 68 | 228 | 100 | 206 | 78 | 238 | 110 | 198 | 70 | 230 | 102 |
| 60 | 188 | 28 | 156 | 52 | 180 | 20 | 148 | 62 | 190 | 30 | 158 | 54 | 182 | 22 | 150 |
| 252 | 124 | 220 | 92 | 244 | 116 | 212 | 84 | 254 | 126 | 222 | 94 | 246 | 118 | 214 | 86 |
| 3 | 131 | 35 | 163 | 11 | 139 | 43 | 171 | 1 | 129 | 33 | 161 | 9 | 137 | 41 | 169 |
| 195 | 67 | 227 | 99 | 203 | 75 | 235 | 107 | 193 | 65 | 225 | 97 | 201 | 73 | 233 | 105 |
| 51 | 179 | 19 | 147 | 59 | 187 | 27 | 155 | 49 | 177 | 17 | 145 | 57 | 185 | 25 | 153 |
| 243 | 115 | 211 | 83 | 251 | 123 | 219 | 91 | 241 | 113 | 209 | 81 | 249 | 121 | 217 | 89 |
| 15 | 143 | 47 | 175 | 7 | 135 | 39 | 167 | 13 | 141 | 45 | 173 | 5 | 133 | 37 | 165 |
| 207 | 79 | 239 | 111 | 199 | 71 | 231 | 103 | 205 | 77 | 237 | 109 | 197 | 69 | 229 | 101 |
| 63 | 191 | 31 | 159 | 55 | 183 | 23 | 151 | 61 | 189 | 29 | 157 | 53 | 181 | 21 | 149 |
| 255 | 127 | 223 | 95 | 247 | 119 | 215 | 87 | 253 | 125 | 221 | 93 | 245 | 117 | 213 | 85 |

i → k →

FIG. 4

METHODS AND APPARATUSES FOR DRIVING DISPLAY SYSTEMS

TECHNICAL FIELD

This disclosure relates to electro-optical devices and methods and, more particularly, to electrophoretic display systems and methods which employ half-toning, or dithering, so that the display device appears to an observer to have a large number of gray tone levels.

BACKGROUND

The driving waveforms for electrophoretic displays provide transitions from a known optical state to another optical state. The controller driving such a display typically offers a fixed number of such optical states, called gray tones, via these waveforms. The gray tones are selected according to criteria such as visual spacing, graininess, transition appearance, update time, etc. The number of possible gray tones in current systems is typically low (2-16) due to limitations such as discreteness of driving pulses imposed by the frame rate of the display drivers and temperature sensitivity. For that reason, it may be desirable to halftone (dither) the image to be displayed so that the display device appears to an observer to have a larger number of gray tone levels.

When driving adjacent pixels of an electrophoretic display with different signals, it is common that an edge artifact is introduced between the adjacent pixels by cross-talk. The edge artifact can be manifested in several ways such as light or dark ridges along the edge, blooming into one of the pixels, smoothed edges, lightened or darkened whole pixel response, etc. In the case of half-toning, the fraction of an area of pixels assigned to various optical states is modified by the artifact, making it difficult to predict the resulting average reflectance. Edge artifacts can be reduced by waveform tuning, but cannot be eliminated completely.

A conventional approach for managing edge artifacts in half-toning is to compensate the halftone dither pattern by input mapping or pattern modification so that the mapping of image levels is acceptable. For example, the mean reflectance of a number of displayed dither patterns can be measured to produce a tone reproduction curve, which can then be inverted to supply an input mapping. This can work well on an electrophoretic display if the prior display state is fixed. However, if the prior display state is an arbitrary image, the compensation method generally does not work because the edge artifacts not only depend on the current state of the pixel pairs but also depend on the prior state of the pixel pairs. This is commonly called "differential blooming", wherein the blooming of a pixel pair is different depending on the prior states of the pixel pair.

Visually, the effect of differential blooming appears as ghosting. For example, a page of black text on a white background may be switched to a page containing a gray scale image containing a smooth gray area such as the sky. In this smooth gray area, the rasterized pattern blooms differently in areas that were previously text compared to white background areas. This leads to a ghost of the text appearing in the sky portion of the image.

SUMMARY

The inventor has recognized that a dither pattern can be utilized to display a current image level based on the dither pattern used to display the previous image level so that differential blooming is compensated. This can be considered as a remapping of the current image pixel level as a function of the remapping used to display the previous image pixel level. Ghosting caused by differential blooming is substantially reduced or eliminated.

Thus, aspects of the disclosed technology include methods and apparatus for image processing where differential blooming is compensated. The method includes accessing a current pattern index for a current pixel based on a current pixel input value and a previous pattern index. The previous pattern index is the pattern index used for the same pixel of the previous image. The previous pattern index may be stored in a pattern index buffer and used to access a lookup table containing the current pattern index. In addition, the method includes accessing a threshold value for the current pixel based on a location of the current pixel. The threshold value may be contained in a dither mask array containing threshold values corresponding to different pixel locations.

The current pattern index is compared with the threshold value, and the result is used to determine a current pixel output value for activation of the current pixel. For example, the current pixel output value may be white if the current pattern index is greater than the threshold value, and otherwise may be black. The current pattern index may be stored in the pattern index buffer at a location corresponding to the current pixel and serves as the previous pattern index for a next image. The method is repeated for each pixel in the image and then is repeated for each subsequent input image. By basing the current pixel output value in part on the previous pattern index, the ghosting caused by differential blooming is substantially reduced or eliminated.

According to a first aspect of the disclosed technology, a method for image processing comprises (a) accessing, in a lookup table, a current pattern index for a current pixel based on a current pixel input value and a previous pattern index; (b) accessing, in a dither mask array, a threshold value for the current pixel based on a location of the current pixel; (c) comparing the current pattern index with the threshold value; (d) determining a current pixel output value for activation of the current pixel based on a result of the comparing; (e) storing the current pattern index to serve as the previous pattern index for a next image; and (f) repeating acts (a)-(e) for each pixel in an image.

According to a second aspect of the disclosed technology, an apparatus for image processing comprises a memory device storing a lookup table configured to provide a current pattern index for a current pixel based on a current pixel input value and a previous pattern index; a dither mask array configured to provide a threshold value based on a location of the current pixel; a comparator circuit configured to compare the current pattern index with the threshold value and to provide a result indicative of a current pixel output value for activation of the current pixel; and a pattern index buffer configured to store the current pattern index as the previous pattern index for each pixel of an image and to provide the previous pattern index for the current pixel based on the location of the current pixel.

According to a third aspect of this disclosed technology, a method for image processing comprises determining a current dither pattern for a current pixel based on a current pixel input value and a previous dither pattern; determining an output value of the current pixel based on the current dither pattern and a threshold value; and activating the current pixel in accordance with the determined output value.

BRIEF DESCRIPTION OF DRAWINGS

Various aspects and embodiments of the application will be described with reference to the following figures. It should be appreciated that the figures are not necessarily drawn to scale. Items appearing in multiple figures are indicated by the same reference number in all the figures in which they appear.

FIG. 3 shows an example of the contents of the lookup table shown in FIG. 2A;

FIG. 4 shows an example of the contents of the dither mask array shown in FIG. 2A;

DETAILED DESCRIPTION

Figure 1:
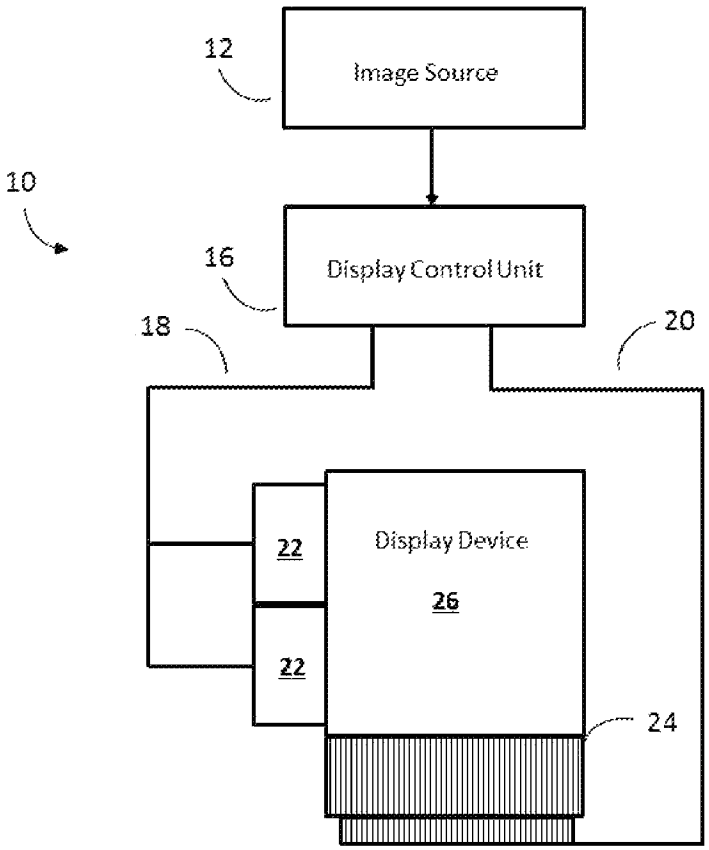
FIG. 1 is a schematic block diagram of a display system in accordance with embodiments.

The term "electro-optic", as applied to a material or a display, is used herein in its conventional meaning in the imaging art to refer to a material having first and second display states differing in at least one optical property, the material being changed from its first to its second display state by application of an electric field to the material. Although the optical property is typically color perceptible to the human eye, it may be another optical property, such as optical transmission, reflectance, luminescence or, in the case of displays intended for machine reading, pseudo-color in the sense of a change in reflectance of electromagnetic wavelengths outside the visible range.

The term "gray state" is used herein in its conventional meaning in the imaging art to refer to a state intermediate two extreme optical states of a pixel, and does not necessarily imply a black-white transition between these two extreme states. For example, several of the E Ink patents and published applications referred to below describe electrophoretic displays in which the extreme states are white and deep blue, so that an intermediate "gray state" would actually be pale blue. Indeed, as already mentioned, the change in optical state may not be a color change at all. The terms "black" and "white" may be used hereinafter to refer to the two extreme optical states of a display, and should be understood as normally including extreme optical states which are not strictly black and white, for example the aforementioned white and dark blue states. The term "monochrome" may be used hereinafter to denote a drive scheme which only drives pixels to their two extreme optical states with no intervening gray states.

Numerous patents and applications assigned to or in the names of the Massachusetts Institute of Technology (MIT) and E Ink Corporation describe various technologies used in encapsulated electrophoretic and other electro-optic media. Such encapsulated media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. The technologies described in these patents and applications include:

(a) Electrophoretic particles, fluids and fluid additives; see for example U.S. Pat. Nos. 7,002,728 and 7,679,814;

(b) Capsules, binders and encapsulation processes; see for example U.S. Pat. Nos. 6,922,276 and 7,411,719;

(c) Films and sub-assemblies containing electro-optic materials; see for example U.S. Pat. Nos. 6,982,178 and 7,839,564;

(d) Backplanes, adhesive layers and other auxiliary layers and methods used in displays; see for example U.S. Pat. Nos. 7,116,318 and 7,535,624;

(e) Color formation and color adjustment; see for example U.S. Pat. Nos. 7,075,502 and 7,839,564;

(f) Methods for driving displays; see for example U.S. Pat. Nos. 5,930,026; 6,445,489; 6,504,524; 6,512,354; 6,531,997; 6,753,999; 6,825,970; 6,900,851; 6,995,550; 7,012,600; 7,023,420; 7,034,783; 7,116,466; 7,119,772; 7,193,625; 7,202,847; 7,259,744; 7,304,787; 7,312,794; 7,327,511; 7,453,445; 7,492,339; 7,528,822; 7,545,358; 7,583,251; 7,602,374; 7,612,760; 7,679,599; 7,688,297; 7,729,039; 7,733,311; 7,733,335; 7,787,169; 7,952,557; 7,956,841; 7,999,787; 8,077,141; 8,125,501; 8,139,050; 8,174,490; 8,289,250; 8,300,006; 8,305,341; 8,314,784; 8,384,658; 8,558,783; and 8,558,785; and U.S. Patent Applications Publication Nos. 2003/0102858; 2005/0122284; 2005/0253777; 2007/0091418; 2007/0103427; 2008/0024429; 2008/0024482; 2008/0136774; 2008/0291129; 2009/0174651; 2009/0179923; 2009/0195568; 2009/0322721; 2010/0220121; 2010/0265561; 2011/0193840; 2011/0193841; 2011/0199671; 2011/0285754; and 2013/0194250;

(g) Applications of displays; see for example U.S. Pat. Nos. 7,312,784 and 8,009,348; and (h) Non-electrophoretic displays, as described in U.S. Pat. Nos. 6,241,921; 6,950,220; 7,420,549, 8,994,705 and 8,319,759; and U.S. Patent Application Publication No. 2012/0293858.

Much of the discussion below will focus on methods for driving one or more pixels of an electro-optic display through a transition from an initial gray level to a final gray level (which may or may not be different from the initial gray level). The term "waveform" will be used to denote the entire voltage against time curve used to effect the transition from one specific initial gray level to a specific final gray level. Typically such a waveform will comprise a plurality of waveform elements; where these elements are essentially rectangular (i.e., where a given element comprises application of a constant voltage for a period of time); the elements may be called "pulses" or "drive pulses". The term "drive scheme" denotes a set of waveforms sufficient to effect all possible transitions between gray levels for a specific display. A display may make use of more than one drive scheme; for example, the aforementioned U.S. Pat. No. 7,012,600 teaches that a drive scheme may need to be modified depending upon parameters such as the temperature of the display or the time for which it has been in operation during its lifetime, and thus a display may be provided with a plurality of different drive schemes to be used at differing temperature etc. A set of drive schemes used in this manner may be referred to as "a set of related drive schemes." It is also possible, as described in several of the aforementioned MEDEOD applications, to use more than one drive scheme simultaneously in different areas of the same display, and a set of drive schemes used in this manner may be referred to as "a set of simultaneous drive schemes."

The inventor has recognized that a dither pattern can be utilized to display a current image level based on the dither pattern used to display the previous image level so that differential blooming is compensated. In the case of a fixed pattern mask, this can be considered as a remapping of the current image pixel level as a function of the remapping used to display the previous image pixel level. Ghosting caused by differential blooming is substantially reduced or eliminated.

Thus, aspects of the disclosed technology include methods and apparatus for image processing where differential blooming is compensated. The method includes accessing a current pattern index for a current pixel based on a current pixel input value and a previous pattern index. The previous pattern index is the pattern index used for the same pixel of the previous image. The previous pattern index may be stored in a pattern index buffer and used to access a lookup table containing the current pattern index. In addition, the method includes accessing a threshold value for the current pixel based on a location of the current pixel. The threshold value may be contained in a dither mask array containing threshold values corresponding to different pixel locations.

The current pattern index is compared with the threshold value, and the result is used to determine a current pixel output value for activation of the current pixel. For example, the current pixel output value may be white if the current pattern index is greater than the threshold value, and otherwise may be black. The current pattern index may be stored in the pattern index buffer at a location corresponding to the current pixel and serves as the previous pattern index for a next image. The method is repeated for each pixel in the image and then is repeated for two or more images. By basing the current pixel output value in part on the previous pattern index, the ghosting caused by differential blooming is substantially reduced or eliminated.

An example of a display system 10 suitable for incorporating embodiments and aspects of the present disclosure is shown in FIG. 1. The display system 10 may include an image source 12, a display control unit 16 and a display device 26. The image source 12 may, for example, be a computer having image data stored in its memory, a camera, or a data line from a remote image source. The image source 12 may supply image data representing an image to the display control unit 16. The display control unit 16 may generate a first set of output signals on a first data bus 18 and a second set of signals on a second data bus 20. The first data bus 18 may be connected to row drivers 22 of display device 26, and the second data bus 20 may be connected to column drivers 24 of display device 26. The row and column drivers control the operation of display device 26. In one example, display device 26 is an electrophoretic display device. For example, the display device 26 may include a display having front and back electrodes and a plurality of capsules within a display layer, where the capsules comprising white and black electrophoretic pigment particles. The front electrode may represent the viewing side of the display, in which case the front electrode may be a transparent conductor, such as Indium Tin Oxide (ITO) (which in some cases may be deposited onto a transparent substrate, such as polyethylene terephthalate (PET)). Furthermore, the display layer can be a particle-based display medium between the front and back electrodes that includes a plurality of capsules. Within each capsules may be a liquid medium and one or more types of colored pigment particles that include white pigment particles and black pigment particles. The pigment particles may be controlled (displaced) with an electric field (e.g., produced by the front and back electrodes), thus making the display operate as an electrophoretic display when addressed. In some use cases, both the black and white pigments may be configured to be displaced within an electric field. For example, one of pigments (e.g., black or white) may be positively charged and the other pigment may be negatively charged, such that an electric field applied across a capsule may cause the pigment particles to separate to opposing sides of the capsule. By adjusting the direction of the electric field, the pigment that is located on the viewing side of the display may be selected, thereby producing either a white or a black state as viewed by a user of the display. In some use cases, one or both of pigments may move within, or otherwise respond to, a magnetic field. For example, one or both types of pigment particles may align along magnetic field lines, and/or may form chains of particles. In such cases, neither, one or both of pigments may be electrically charged. Furthermore, the display control unit 16 may include dither apparatus as described below.

Figure 2A:
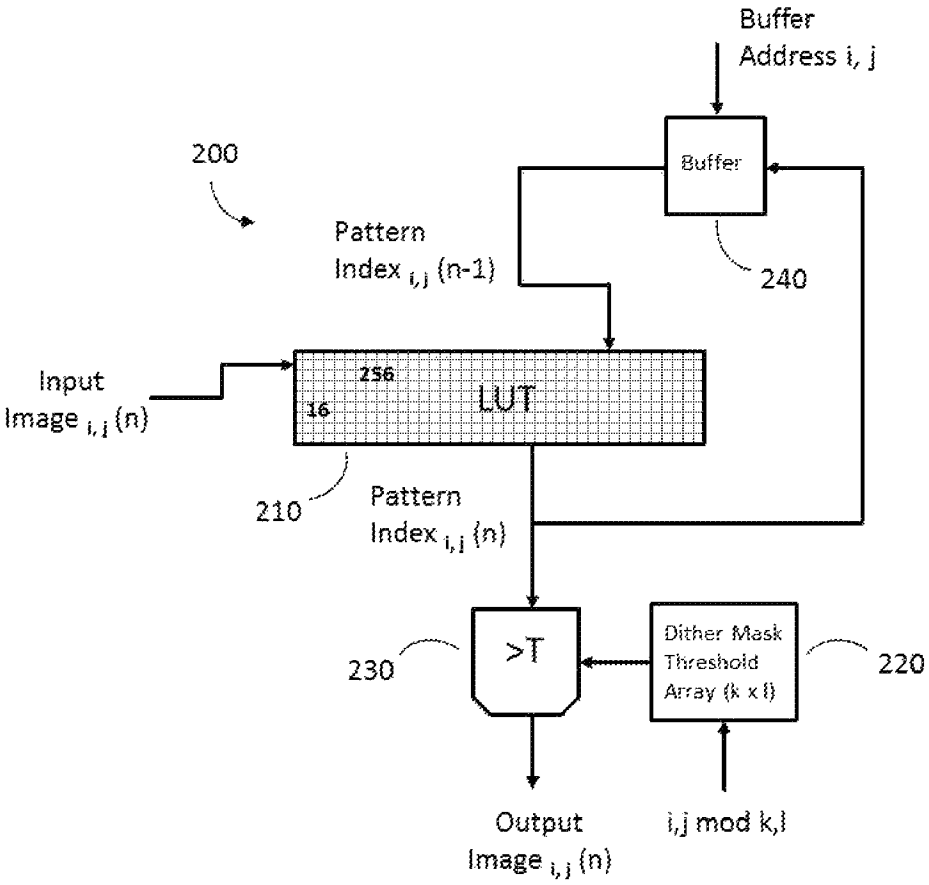
FIGS. 2A & 2B are schematic block diagrams of image processing apparatus in accordance with embodiments.
Figure 2B:
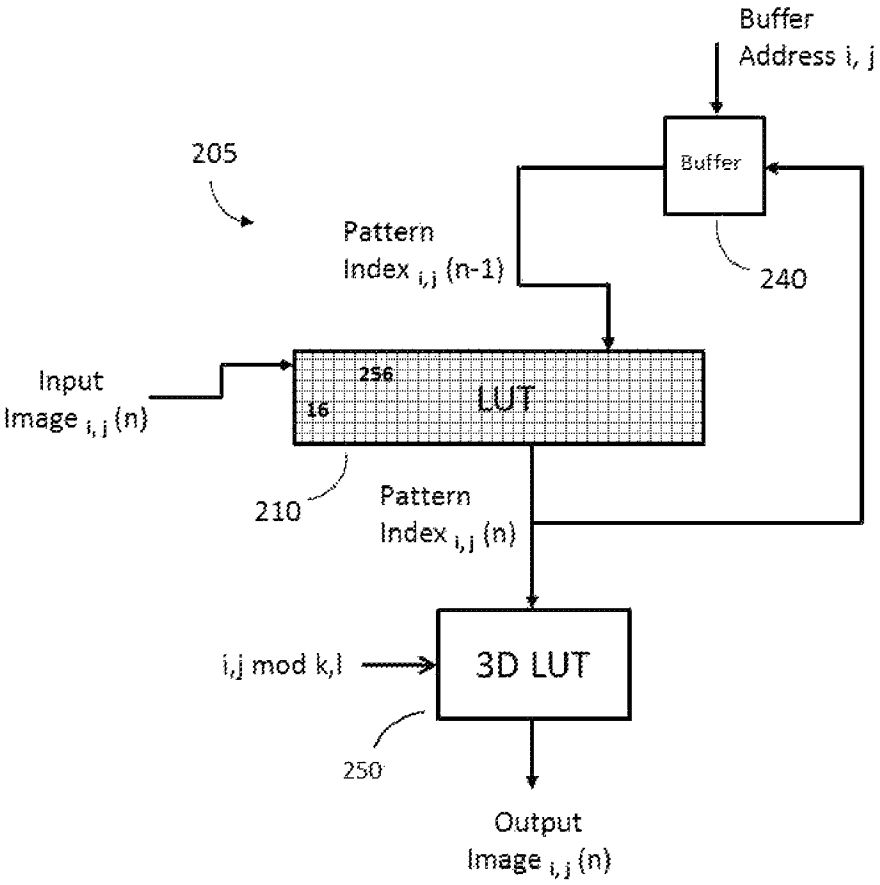

A block diagram of image processing apparatus 200 in accordance with embodiments of the disclosure is shown in FIGS. 2A and 2B. The image processing apparatus, implemented as a dither apparatus 200, applies a dither pattern to display a current image level based on the dither pattern used to display the previous image level so that differential blooming is compensated by the applied pattern density. In the case of a fixed pattern mask, this can be considered as a remapping of the current image pixel level as a function of the previous image pixel level. Using this approach, the ghosting caused by differential blooming is substantially reduced or eliminated.

As shown in FIG. 2A, dither apparatus 200 includes a memory device storing a lookup table (LUT) 210, a dither mask array 220, a comparator 230 and a pattern index buffer 240. The dither apparatus 200 of FIG. 2 implements one-bit dithering. The lookup table 210 is used to provide a current pattern index M for a current pixel based on the previous pattern index at that pixel and the current pixel input value. The current pattern index M is compared to a threshold value T provided by the dither mask array 220 to determine if the pixel is black or white. The current pattern index for current image n is stored in the pattern index buffer 240 and serves as the previous pattern index for a next image n+1.

Referring to FIG. 2A, the lookup table 210 is addressed, in part, input by a current pixel input value for a current pixel at location i,j of image n. The pixel at location i,j is the pixel at line i, column j of the image and is sometimes referred to herein as "pixel i,j". In the example of FIG. 2, the current pixel input value may have one of 16 gray tone values. The lookup table 210 is also addressed by the previous pattern index of the pixel at location i,j. As shown, the previous pattern index is provided by pattern index buffer 240.

The current pattern index M for the pixel at location i,j of image n is supplied by the lookup table 210 to one input of comparator 230. A second input of comparator 230 is provided by dither mask array 220. The dither mask array 220 may have dimensions of k×l, and the dither mask array 220 is addressed by the location i,j of the pixel mod k,l, where k is a line and l is a column of the dither mask array 220. The mod function serves to tile the dither mask array over the area of the image. The dither mask array 220 typically has a smaller number of pixels than the image and, in an example described below, may have dimensions of 16×16 pixels.

The dither mask array 220 provides the threshold value T to a second input of comparator 230. The comparator 230 compares the current pattern index M from lookup table 210 with the threshold value T from dither mask array 220. If the current pattern index M of pixel i,j is greater than the threshold value T from dither mask array 220, the output value for the current pixel is white; otherwise the output value is black. It will be understood that the assignment of white and black values is arbitrary and can be reversed. The output value is provided to the display device 26 (FIG. 1) or to additional processing circuitry in display control unit 16.

The pattern index buffer 240 may store one pattern index for each pixel in the image. The pattern index buffer 240 is addressed by the location of the pixel being processed. Thus, the pattern index buffer 240 receives pixel location i,j. In operation, the current pattern index for pixel i,j of image n is stored in pattern index buffer 240 at location i,j. The stored current pattern index for each pixel becomes the previous pattern index and is read out from the pattern index buffer 240 when processing the next image. Thus, the current pattern index depends in part on the previous pattern index for the pixel at location i,j.

The values in lookup table 210 may be obtained by measuring the average reflectance of sets of dither pattern pairs. Because the dither pattern array is applied periodically in a fixed position, a pattern pair will always contain the same sets of pairwise neighbor transitions and so the blooming effect is accounted for in this measurement.

To fill the table, first determine a desired reflectance for each gray level to be reproduced on the display. The desired gray level for black and white should be no darker or whiter respectively than the best possible states that can be reproduced. All other gray tones are typically chosen to be equally spaced by some metric, such as L*. Now choose a previous pattern index and an input gray tone. In the most straightforward approach, set the display to the pattern of this constant previous pattern index and then update the display to an image or images of all available patterns for the current pattern index. Measure the reflectance of each of these and determine the current pattern index which most closely matches the target reflectance for the chosen gray tone. This pattern index is put into the table at the position associated with the previous pattern index and chosen gray tone. This process needs to be repeated for all previous pattern indices and gray tones.

Clearly the number of measurements required to fill this table can be reduced by various algorithms. For example, a search method though the current pattern index possibilities can be applied such as a divide and conquer approach. Also, because the table entries are expected to have some continuous relationship, values of adjacent entries can be used as a starting place for a search. Furthermore, more advanced methods could build up a model of the neighborhood interactions in order to predict the reflectance of the previous and current pattern pair based on only restricted number of model parameters that would need to be determined by measurement.

FIG. 2B shows an alternative implementation of the dither process shown in FIG. 2A where the whole pattern for each level is stored in a LUT 250 and accessed without doing a computation. This implementation still uses the dither process, such that there's a fixed spatial output produced for a fixed input gray tone.

An example of lookup table 210 is shown in FIG. 3. The example of lookup table 210 in FIG. 3 is organized as a table with different pixel input values listed horizontally across the top of the table and different previous pattern index values listed vertically along the left side of the table. In the example of FIG. 3, the pixel may have 1 of 16 input values corresponding to different gray tone values ranging from white to black. The previous pattern index may have values ranging from 1 to 256 corresponding to different dither patterns as discussed below. It will be understood that the pixels may have more or fewer input values and that the previous pattern index may have more or fewer values than the example of FIG. 3. For simplicity of illustration, FIG. 3 illustrates only a few of the entries in the lookup table 210. The complete lookup table 210, according to the example of FIG. 3, has 16×256 entries.

The values in lookup table 210 may be obtained by measuring the average reflectance of sets of dither pattern pairs. Because the dither pattern array is applied periodically in a fixed position, a pattern pair will always contain the same sets of pairwise transitions and so the edge behavior can be accounted for in regions switching from one constant gray level to a second constant gray level by this measurement. In particular, paired images of constant pattern index are displayed one after the other and the reflectance is measured until a good prediction of lightness can be made for (previous, current) pattern pairs. An interpolation into this data can be based on a model of the neighborhood types present in the image pairs. Since the blooming artifacts are local, it is sufficient to model the effect on lightness of the 55 possible (up to symmetry) 2×2 previous and current neighborhood configurations. The interpolation is inverted with respect to the current pattern index to obtain the current pattern required to provide a desired lightness based on the input pixel value and the previous pattern index.

Examples will now be described with reference to the lookup table 210 of FIG. 3. In a first example, the pixel at location 5,9 of image n (the pixel at line 5, column 9 of image n) has a pixel input value of 4. The previous pattern index having a value of 21 is supplied by pattern index buffer 240. The pixel input value of 4 and the previous pattern index of 21 are used to address the lookup table 210 of FIG. 3. The lookup table 210 contains a current pattern index of 49 at a pixel input value of 4 and a previous pattern index of 21. The current pattern index of 49 is provided to the comparator 230 (FIG. 2A) for comparison with the threshold value. Also the current pattern index 49 is stored in pattern index buffer 240 at pixel location 5,9 and serves as the previous pattern index for the next image.

In a next image n+1, the pixel at location 5,9 has a pixel input value of 6. The pattern index buffer 240 provides the previous pattern index of 49 at pixel location 5,9. The pixel input value of 6 and the previous pattern index of 49 are used to access the lookup table 210 of FIG. 3, providing a current pattern index of 83.

In a further example, assume that the pixel at location 5,9 for the next image n+1 has a pixel input value of 2. As in the previous example, the previous pattern index has a value of 49. The lookup table 210 of FIG. 3 provides a current pattern index value of 19 for a pixel input value of 2 and a previous pattern index value of 49. It may be observed that the current pattern index used to determine the current state of the current pixel depends not only on the current pixel input value, but also on the previous pattern index value.

An example of dither mask array 220 is shown in FIG. 4. The dither mask array 220 is organized as a table with pixel columns l across the top of the table and pixel lines k down the left side of the table. In the example of FIG. 4, the dither mask array 220 has dimensions of 16×16, with each location in the table containing a threshold value to be compared with the current pattern index value. As indicated above, the pixel location i,j in the image is applied to dither mask array 220 mod k,l, thus tiling the dither mask array 220 over the area of the image.

The dither mask array 220 is an implementation of ordered dithering which produces a fixed spatial pattern for each gray scale level. The spatial patterns, discussed below, can be specified for each different gray scale level. Conversion of the original gray scale image to a halftone image is equivalent to assigning each pixel a black or white level based on looking up that pixel's position in the gray scale pattern for that pixel's particular gray level. Thus, the pixel input value can be considered a pattern index which selects a predefined black and white pattern and the pixel's position is used to index the dither mask array to determine whether the output should be black or white.

Referring to the examples described above, the pixel at location 5,9 for image n has a current pattern index value of 49. Using the pixel location 5,9 to address dither mask array 220, where k=5 and l=9, provides a threshold value of 14. The threshold value of 14 is compared by comparator 230 with the current pattern index value of 49. Since the current pattern index is greater than the threshold value, the output value of the pixel at location 5,9 is white.

Figure 5:
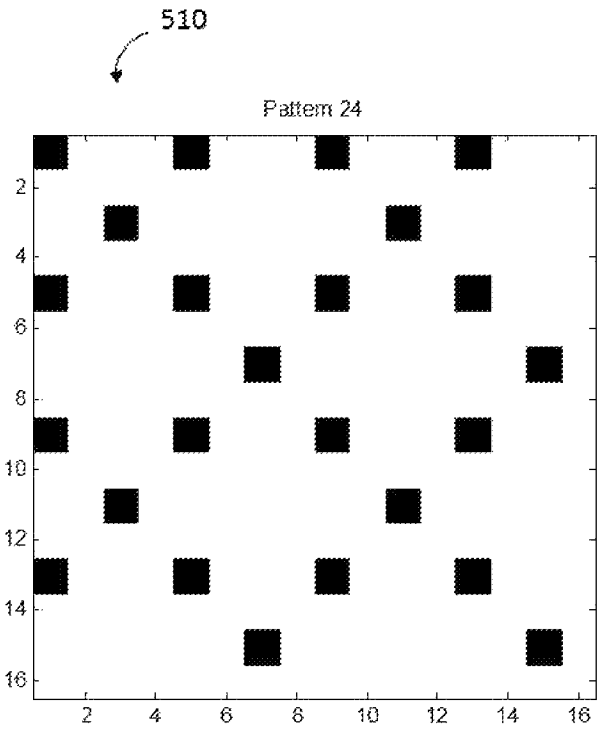
FIG. 5 shows an example of a 16×16 dither pattern having 24 black pixels.

An example of a 16×16 dither pattern 510 having 24 black pixels is shown in FIG. 5. The dither pattern 510 may have a pattern index of 24.

Figure 6:
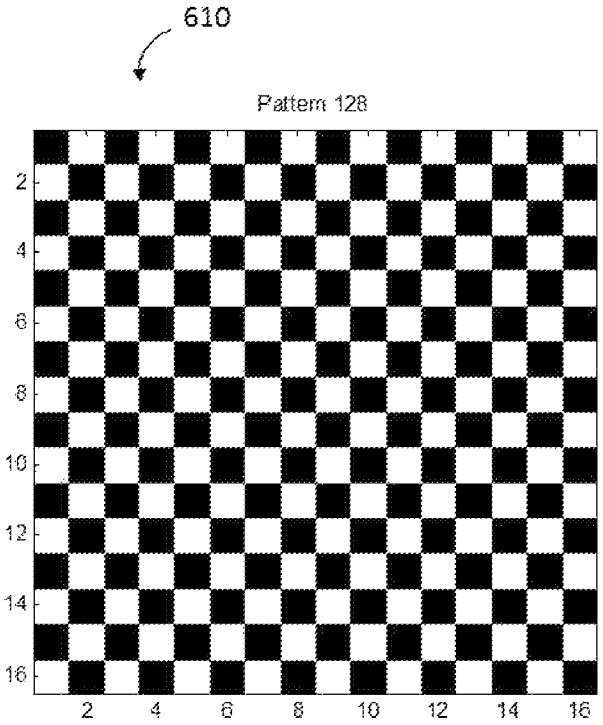
FIG. 6 shows an example of a 16×16 dither pattern having 128 black pixels.

An example of a 16×16 dither pattern 610 having 128 black pixels is shown in FIG. 6. The dither pattern 610 may have a pattern index of 128.

Figure 7:
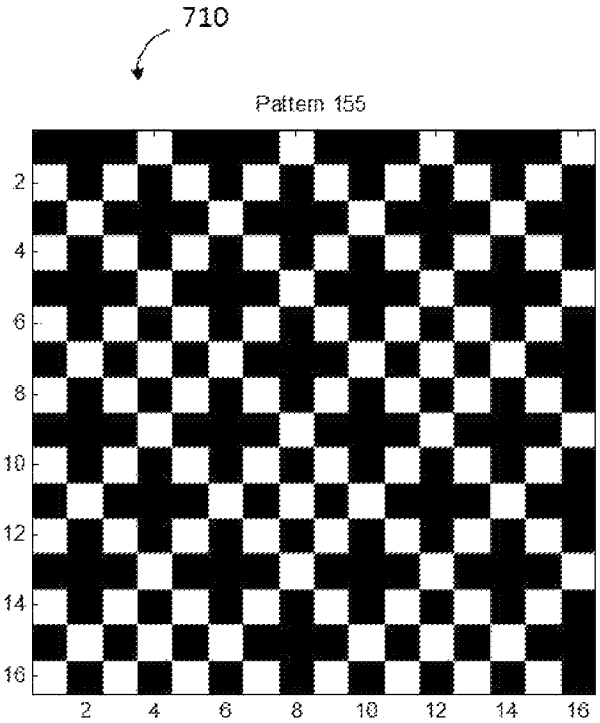
FIG. 7 shows an example of a 16×16 dither pattern having 155 black pixels.

An example of a 16×16 dither pattern 710 having 155 black pixels is shown in FIG. 7. The dither pattern 710 may have a pattern index of 155.

Each of the dither patterns 510, 610, 710 represents a 16×16 array of pixels wherein selected pixels are black and the remaining pixels are white. The number of black pixels in the dither pattern, when averaged by the viewer's eye, represents a particular gray tone level. Thus, the dither pattern 510 of FIG. 5 is a lighter gray tone than the dither pattern 710 of FIG. 7. The black pixels in each dither pattern may be more or less uniformly distributed over the area of the dither pattern for best results.

Figure 8:
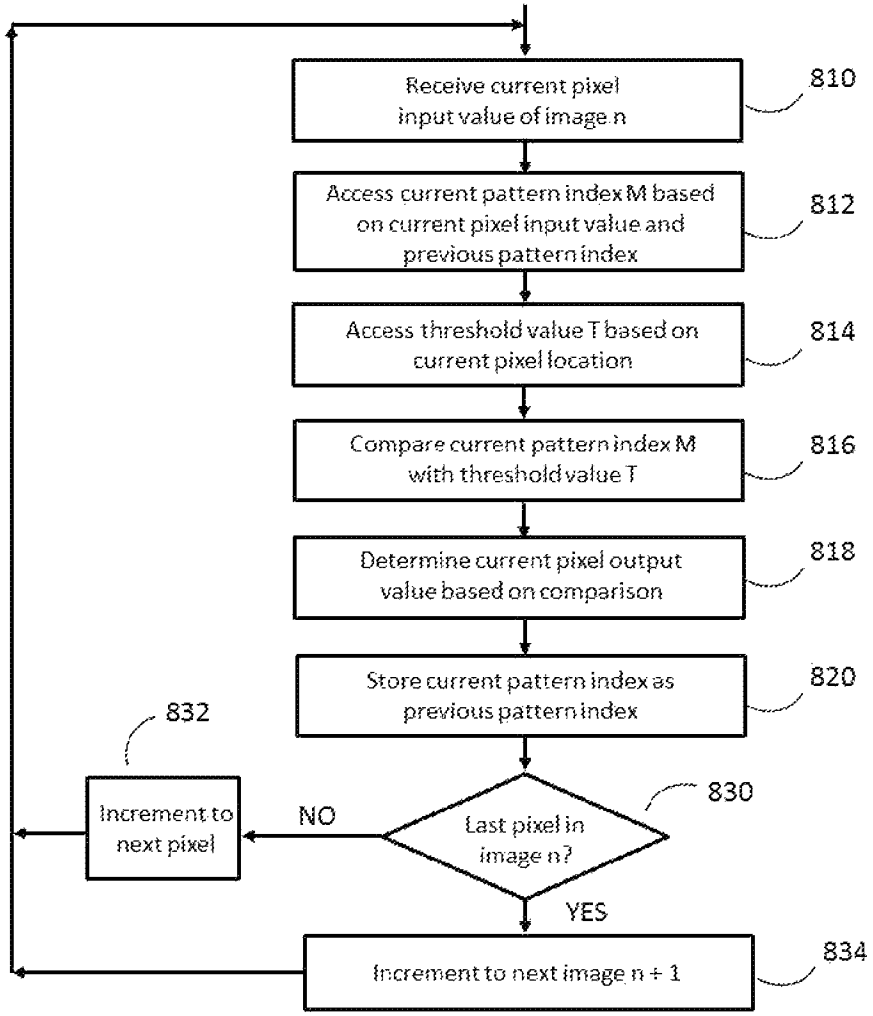
FIG. 8 is a flowchart of a method for image processing in accordance with embodiments.

A flow chart of a method for image processing in accordance with embodiments of the disclosure is shown in FIG. 8. The image processing method of FIG. 8 may be performed by the image processing apparatus shown in FIG. 2 and described above, or other suitable processing apparatus.

Referring to FIG. 8, a current pixel input value of image n is received in act 810. A current pattern index M is accessed based on the current pixel input value and a previous pattern index in act 812. As discussed above, the current pattern index M may be accessed in lookup table 210. A threshold value T is accessed in act 814 based on a location of the current pixel. As discussed above, the threshold value T may be accessed in dither mask array 220 based on the current pixel location.

The current pattern index M is compared with the threshold value T in act 816. The comparison may be performed by comparator 230 shown in FIG. 2 and described above. The current pixel output value is determined in act 818 based on a result of the comparison of act 816. For example, if the current pattern index M is greater than the threshold value T then the current pixel output value is white; otherwise the current pixel output value is black. In act 820, the current pattern index of image n is stored as the previous pattern index of image n+1. The previous pattern index may be stored in pattern index buffer 240 shown in FIG. 2 and described above.

In act 830, a determination is made as to whether the current pixel is the last pixel in image n. If the current pixel is determined in act 830 not to be the last pixel in image n, the process proceeds to act 832 and increments to the next pixel of image n. The process then returns to act 810 for receiving another pixel value of image n. If the current pixel is determined in act 830 to be the last pixel in image n, the process proceeds to act 834 and increments to the next image n+1. The process then returns to act 810 and receives a pixel input value of the next image n+1.

The dither apparatus 200 of FIG. 2A and the dither apparatus 205 of FIG. 2B and the method for image processing of FIG. 8 have been described in terms of processing one pixel at a time. In some implementations, several pixels may be processed in parallel. For example, multiple pixels in a line of the display device may be processed in parallel.

The image processing methods and apparatus described above produce a black or white output value for each pixel. The image processing methods and apparatus described herein can also be applied in the case of display devices capable of generating multiple gray tone levels for each pixel. It is also true in the multi-level dithering process that if the input is a constant image, a fixed output pattern is produced by the half-toning process. Since there is a fixed relationship between the neighborhoods in the current and next pattern, the average effect of blooming can likewise be predicted.

In one implementation, the dither mask array is used to dither between adjacent output levels of a N-level display device. For example, assume that the display device may receive pixel values [1, 100, 200, 256]. If the current pattern index M is in a range between 100 and 200, the current pattern index is scaled and is compared with the threshold value to choose output level 200 or output level 100.

The above-described embodiments can be implemented in any of numerous ways. One or more aspects and embodiments of the disclosure involving the performance of processes or methods may utilize program instructions executable by a device (e.g., a computer, a processor, or other device) to perform, or control performance of, the processes or methods. Various concepts and features may be embodied as a computer-readable storage medium or multiple computer-readable storage media (e.g., a computer memory, one or more compact discs, floppy disks, compact discs, optical disks, magnetic tapes, flash memories, circuit configurations in field programmable gate arrays or other semiconductor devices, or other tangible computer storage medium) encoded with one or more programs that, when executed on one or more computers or other processors, perform methods that implement one or more of the various embodiments described above. The computer-readable medium or media can be transportable and may be non-transitory media.

When the embodiments are implemented in software, the software code can be executed on any suitable processor or collection of processors. A computer may be embodied in any of a number of forms, such as a rack-mounted computer, a desktop computer, a laptop computer, or a tablet computer, as non-limiting examples. Additionally, a computer may be embedded in a device not generally regarded as a computer but with suitable processing capabilities, including a personal digital assistant, a Smart phone or any other suitable portable or fixed electronic device.

Having thus described at least one illustrative embodiment of the disclosure, various alterations, modifications and improvements will readily occur to those skilled in the art. Such alterations, modifications, and improvements are intended to be part of this disclosure, and are intended to be within the spirit and the scope of the present disclosure. Accordingly, the foregoing description is by way of example only and is not intended to be limiting. The various inventive aspects are limited only as defined in the following claims and the equivalents thereto.

The invention claimed is:

1. A method for image processing comprising:

(a) accessing, in a lookup table, a current pattern index for a current pixel based on a current pixel input value and a previous pattern index;

(b) accessing, in a dither mask array, a threshold value for the current pixel based on a location of the current pixel;

(c) comparing the current pattern index with the threshold value;

(d) determining a current pixel output value for activation of the current pixel based on a result of the comparing;

(e) storing the current pattern index to serve as the previous pattern index for a next image; and (f) repeating acts (a)-(e) for each pixel in an image to reduce differential blooming.

2. The method for image processing as defined in claim 1, further comprising repeating acts (a)-(f) for a plurality of images.

3. The method for image processing as defined in claim 1, wherein determining the current pixel output value comprises determining a first output value or a second output value.

4. The method for image processing as defined in claim 3, wherein determining the current pixel output value comprises determining the first output value if the current pattern index is greater than the threshold value and otherwise determining the second output value.

5. The method for image processing as defined in claim 1, wherein determining the current pixel output value comprises determining one of three or more pixel output values.

6. The method for image processing as defined in claim 1, wherein storing the current pattern index comprises storing the current pattern index in a pattern index buffer.

7. The method for image processing as defined in claim 6, wherein the pattern index buffer has a location for each pixel in the image.

8. The method for image processing as defined in claim 1, wherein the dither mask array is addressed by the location of the current pixel mod k,l, where k and 1 are dimensions of the dither mask array.

9. The method for image processing as defined in claim 1, wherein comparing the current pattern index comprises determining if the current pattern index is between a first threshold value and a second threshold value.

10. The method for image processing as defined in claim 1, further comprising activating the current pixel of an electrophoretic display in accordance with the determined current pixel output value.

11. Apparatus for image processing comprising:

a memory device storing a lookup table configured to provide a current pattern index for a current pixel based on a current pixel input value and a previous pattern index;

a dither mask array configured to provide a threshold value based on a location of the current pixel;

a comparator circuit configured to compare the current pattern index with the threshold value and to provide a result indicative of a current pixel output value for activation of the current pixel; and a pattern index buffer configured to store the current pattern index as the previous pattern index for each pixel of an image and to provide the previous pattern index for the current pixel based on the location of the current pixel to reduce differential blooming.

12. The apparatus for image processing as defined in claim 11, further comprising a display control unit configured to control the apparatus to provide the result indicative of the current pixel output value for each pixel in an image.

13. The apparatus for image processing as defined in claim 12, wherein the display control unit is configured to control the apparatus to provide the result indicative of the current pixel output value for a plurality of images.

14. The apparatus for image processing as defined in claim 11, wherein the comparator circuit is configured to provide the result indicative of a first output value or a second output value.

15. The apparatus for image processing as defined in claim 14, wherein the comparator circuit is configured to provide the first output value if the current pattern index is greater than the threshold value and otherwise to provide the second output value.

16. The apparatus for image processing as defined in claim 11, wherein the comparator circuit is configured to provide the result indicative of one of three or more pixel output values.

17. The apparatus for image processing as defined in claim 11, wherein the pattern index buffer has a location for each pixel in the image.

18. The apparatus for image processing as defined in claim 11, wherein the dither mask array is addressed by the location of the current pixel mod k, 1, where k and 1 are dimensions of the dither mask array.

19. The apparatus for image processing as defined in claim 11, wherein the comparator circuit is configured to determine if the current pattern index is between a first threshold value and a second threshold value.

20. The apparatus for image processing as defined in claim 11, wherein the comparator circuit is configured to provide the result indicative of the current pixel output value of an electrophoretic display.

* * * * *